US007766569B2

(12) United States Patent
Martin et al.

(10) Patent No.: US 7,766,569 B2
(45) Date of Patent: Aug. 3, 2010

(54) METHOD FOR REDUCING MEDIA SKEW IN A MEDIA ADVANCE MECHANISM

(75) Inventors: Eduardo Martin, Sabadell (ES); Martin Urrutia, Sant Cugat del Valles Barcelona (ES); Antonio Monclus, Castelldefels (ES); Jordi Gimenez, Rubi (ES); David Claramunt, Sant Esteve Sesrovires (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 740 days.

(21) Appl. No.: 11/699,557

(22) Filed: Jan. 30, 2007

(65) Prior Publication Data

US 2008/0181707 A1 Jul. 31, 2008

(51) Int. Cl.
*B41J 11/00* (2006.01)
*B41J 13/02* (2006.01)
*B41J 13/08* (2006.01)

(52) U.S. Cl. ..... 400/579; 271/226; 271/228; 347/104; 400/636

(58) Field of Classification Search ..... 271/226, 271/228, 274; 347/104; 400/579, 624, 636
See application file for complete search history.

(56) References Cited

U.S. PATENT DOCUMENTS 5,138,381 A * 8/1992 Masaki et al. ..... 399/159
5,815,186 A * 9/1998 Lewis et al. ..... 347/101
5,913,268 A * 6/1999 Jackson et al. ..... 101/420
5,947,617 A 9/1999 Kondo ..... 400/579
6,845,227 B2 * 1/2005 Nishino et al. ..... 399/406
2004/0141039 A1 * 7/2004 Choi et al. ..... 347/102
2007/0079712 A1 * 4/2007 Costrop et al. ..... 101/228

FOREIGN PATENT DOCUMENTS

EP 1 094 022 4/2001
JP 2001-302014 * 10/2001

* cited by examiner

*Primary Examiner*—Ren Yan
*Assistant Examiner*—Marissa L Ferguson-Samreth

(57) ABSTRACT

The method comprises the steps of feeding media from a media roll, arranged about an axis, through an input driving device and an output driving device of the media advance mechanism, wherein the output driving device engages the media with lower friction than said input driving device; releasing said input driving device such that it does not engage the media; and causing the media to move in the media advance mechanism such that the media is pulled taut between the roll and the output driving device and later the media slips with respect to said output driving device, whereby the media is aligned at right angles to the roll axis by effect of the friction between the media and the output driving device.

20 Claims, 3 Drawing Sheets

METHOD FOR REDUCING MEDIA SKEW IN A MEDIA ADVANCE MECHANISM

Figure 1:
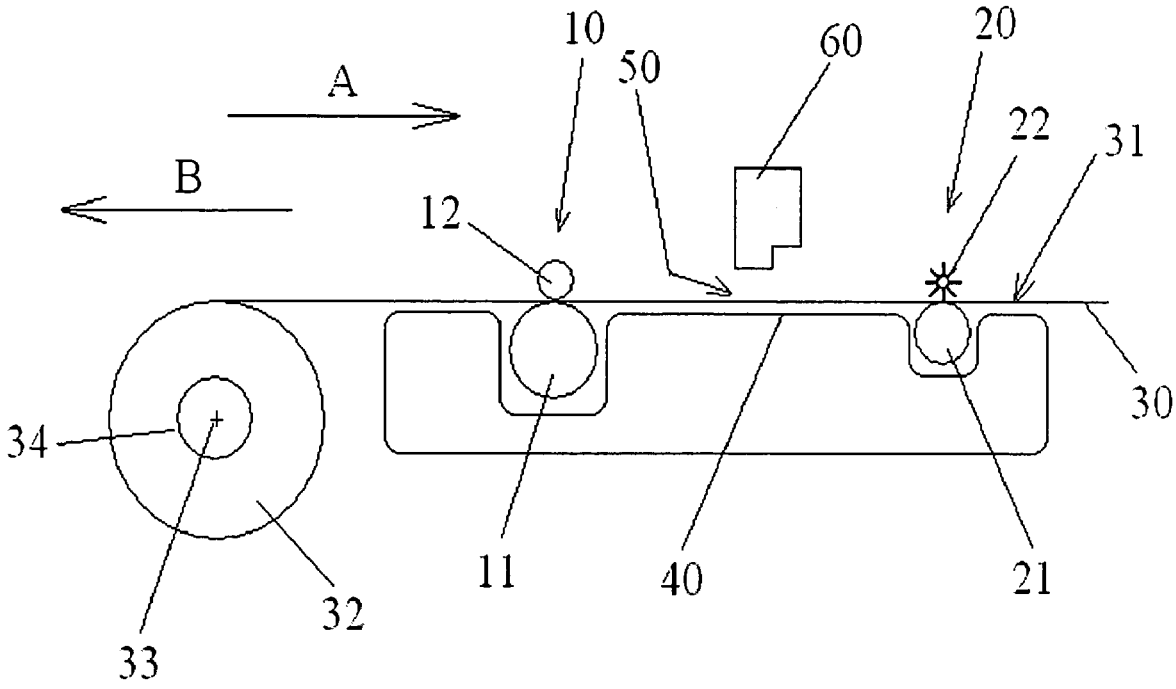

The present invention relates to a method for reducing media skew in a media advance mechanism.

A number of apparatus and devices are provided with a media advance mechanisms for causing a media such as paper, fabric, cardboard or the like to advance through the apparatus in order to perform some operation on the media. The media advance mechanism of an inkjet printer, for example, causes a printing media such as a sheet or web of paper, textile or other substrate to travel in an advance direction through a print zone, where a printhead deposits ink on the media in successive swaths.

The advance mechanism, especially in a large format apparatus, may comprise an input driving device, generally arranged upstream of the print zone, and an output driving device, generally arranged downstream of the print zone with respect to the media advance direction.

In some cases the media is a paper web which is fed from a roll, the roll being mounted on a spindle or supported in some other way on the printer structure.

Accurate positioning of the media when the media is fed to a printer is an issue that has to be addressed, especially when working with a web of media, since skew of the media when the leading edge is fed to the printer may lead to an increasing media positioning error as the media advances through the printer, with the risk of causing errors in the position of the dots of ink ejected by the printhead, and thus print defects and/or poor print quality.

In consequence, it is known to provide a physical reference (for example a line printed on the platen), to assist the user in the correct positioning of the media edge when a new roll is loaded in the printer, and it is also known to verify the skew of the media once a small length has traveled through the driving devices. In some cases, if the measured skew exceeds a predetermined threshold value, the user must withdraw the media from the printer and repeat the loading operation.

For user satisfaction it is desirable to reduce as much as possible the need to repeat the loading operation. Thus, some methods have been developed for removing media skew after the user has positioned the media with respect to a reference on the platen and the media has been engaged by the driving devices.

One known method involves driving a length of media forward and backward several times through the printer, until skew is reduced; however, this may require moving a significant amount of media, and in practice it is only possible if the printer is provided with a motor to rewind the media on the media roll.

Another method implemented in some printers involves performing a stepwise media advance in small lengths of e.g. 10 cm, and checking the skew after every advance, until it falls below a predetermined value; then the media is rewound backwards, either with a motor or by hand, to avoid media waste. This process may be very time consuming, and in general it leads to a relatively large amount of media remaining loose upstream of the printheads before the printing operation finally starts.

Furthermore, these known methods may cause wrinkles in the print media, especially when a relatively thin print media is being used, because a significant length of media travels through the printer in a skewed condition.

The present invention addresses the problem of reducing media skew while avoiding at least partially some of the above problems.

The present invention provides a method for reducing media skew in a media advance mechanism, comprising the steps of:

feeding media from a media roll, arranged about an axis, through an input driving device and an output driving device of the media advance mechanism, wherein the output driving device engages the media with lower friction than said input driving device;

releasing said input driving device such that it does not engage the media; and causing the media to move in the media advance mechanism such that the media is pulled taut between the roll and the output driving device and later the media slips with respect to said output driving device, whereby the media is aligned at right angles to the roll axis by effect of the friction between the media and the output driving device.

Such a method obtains better skew correction than the known methods mentioned above, and also reduces the risk of causing wrinkles in the media.

Furthermore, a good balance may be achieved between the maximum skew that is accepted when loading, which is related to the print quality, and the success rate in the loading operation, which is directly related to the satisfaction of the user.

When the method is performed on a printer, skew reduction allows an improved printing quality and small margin variations from the first printed plot.

Figure 2A:
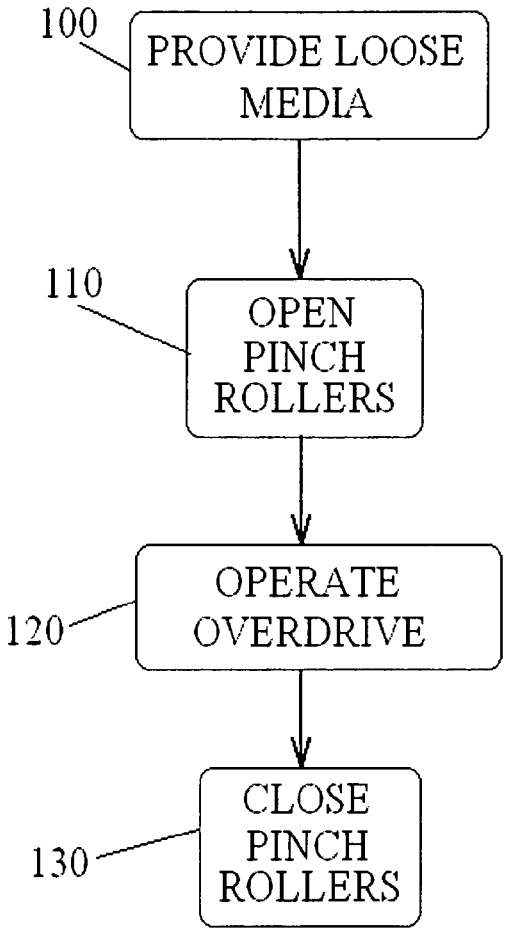
Figure 2B:
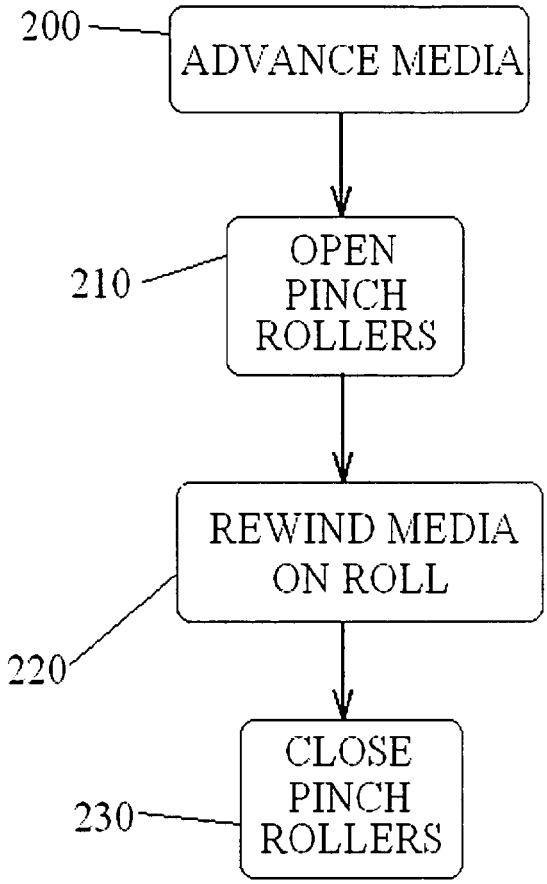
Figure 3:
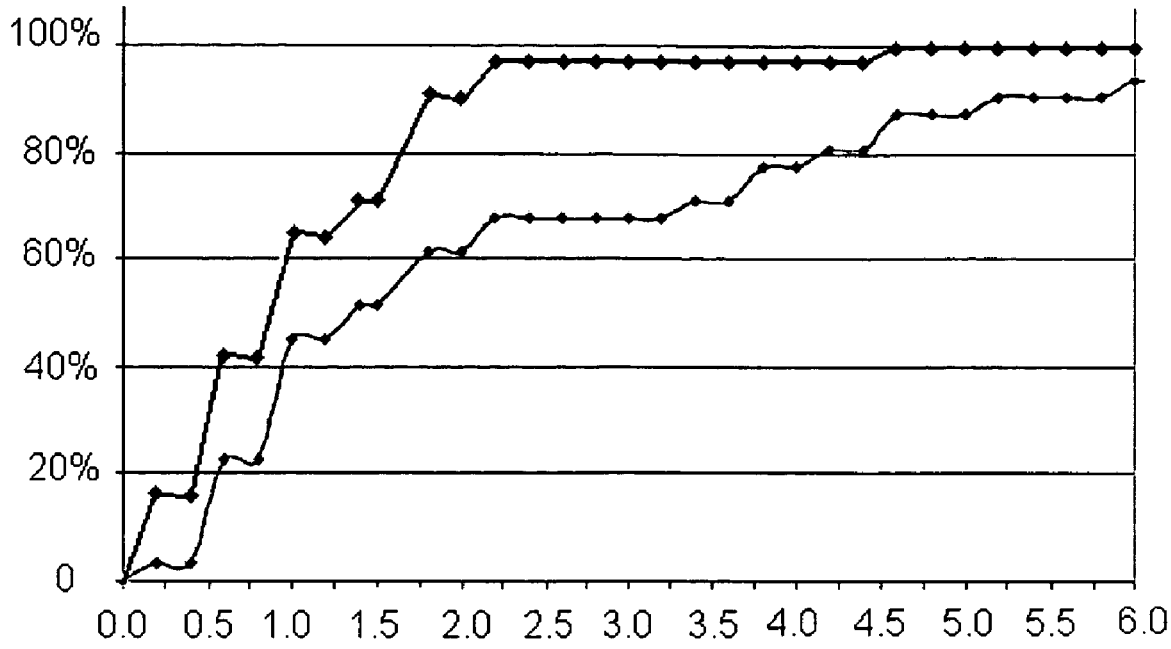

Particular embodiments of the present invention will be described in the following, only by way of non-limiting example, with reference to the appended drawings, in which:

FIG. 1 is a schematic drawing showing in vertical cross section the arrangement of some elements of a media advance mechanism in one embodiment of a printer, for example an inkjet printer;

FIGS. 2*a* and 2*b* are flow diagrams of methods for reducing skew according to embodiments of the invention; and FIG. 3 is a graph showing the effect of one embodiment of a method for reducing skew according to the invention on the success rate of the media loading operation.

In FIG. 1, a media advance mechanism of a printer comprises an input driving device 10 and an output driving device 20 for driving the print media 30 through the printer, usually on a platen 40, in a media advance direction A. The input driving device 10 is arranged at the media inlet of the printer, upstream of a printzone 50 where ink is deposited on the media from a printhead 60, while the output driving device 20 is arranged downstream of the printzone 50.

The input driving device 10 may comprise for example a grit roller 11 and a plurality of pinch rollers 12 spanning the width of the media 30, the media being engaged between the grit roller 11 and the pinch rollers 12, while in the output driving device 20 or overdrive the media is engaged between several sets of rubber rollers 21 and star wheels 22, placed at intervals across the width of the media, with the rubber rollers 21 underneath the media and the star wheels 22 in contact with the printed surface 31.

With this kind of media advance mechanism, the input driving device 10 engages the print media 30 with a higher degree of friction than the output driving device 20; in an inkjet printer, for example, the output driving device 20 cannot engage the media with high pressure or friction, because the ink on the media is still at least partly wet. In some models of large format inkjet printers, for example, the force exerted by the pinch rollers and grit roller may be around 100 N/m, while the force exerted by the overdrive may be for example about 2-10 N/m.

For some embodiments of the present invention it is appropriate that the force exerted by the output driving device on the media is between 2 N/m and 10 N/m, and/or that the friction between the media and the output driving device is for example at least 10 times lower than the friction between the media and the input driving device.

The output driving device may also be of the kind comprising a vacuum system instead of star wheels, the vacuum system being suitable for urging the media against the driving roller.

The media 30 may be a web of paper or other print substrate which is held on a roll 32 arranged about an axis 33. In use, the roll may be mounted on a spindle 34 or the like, and the spindle 34 is inserted in appropriate supports (not shown) of the printer.

When a new media roll is loaded in the printer, the user feeds the leading edge of the media to the input driving device 10, which drives it forward through the printer until the edge of the media reaches and engages the outlet driving device 20, and travels a distance past the outlet device 20. At this point the media is engaged in the advance mechanism of the printer, but it may have a certain degree of skew.

In embodiments of the present invention, skew is measured at this point. If the measured skew is below a predetermined lower skew limit, then no correction is required; if, on the contrary, skew is above a predetermined upper skew limit, then the loading operation fails and the user is instructed to remove the media from the printer and load it again. If the measured skew is between these two limits, then a skew correction method is performed. The lower and upper skew limits depend inter alia on the kind of media; in some embodiments a suitable lower limit may be about 3 mm/m, and a suitable upper limit about 15 mm/m.

In embodiments of the skew correction method, the input driving device 10 is first released, for example by raising the pinch rollers 12 with respect to the grit roller 11, in such a way that the media 30 is disengaged from the input driving device 10 and remains engaged only in the overdrive device 20.

The media 30 is then caused to move in the media advance device, either pulled forward (direction A) by operating the overdrive 20, or rewound towards the media roll 32 (direction B) while the overdrive 20 is maintained stationary.

In the first case, friction between the media and the overdrive 20 will cause a pull on the media 30 in the advance direction A, but the media 30 will have a small advance, if any. It will be displaced sideways or undergo a degree of rotation, because due to the existing skew the pull exerted by the overdrive will not have a uniform effect across the media; and it will soon start slipping in the overdrive 20, due to the limited amount of friction between the media and the rubber rollers 21 and star wheels 22 and to the resistance of the media roll 32. This resistance may be due simply to the weight of the media roll 32, or to a friction brake or other device associated to the media roll spindle 34.

In the second case, in which the media 30 is rewound towards the media roll 32 in the direction B instead of being advanced, the media 30 will be retained to some extent by the overdrive 20: however, the limited amount of friction between the media 30 and the overdrive 20 will cause the latter to initially retain the media and then allow it to slip. Like in the previous case, the pull exerted by the overdrive will not have a uniform effect across the media, due to existing skew, and the media will be displaced sideways or undergo a degree of rotation while it travels in the direction B.

Consequently, in both cases, the media is pulled taut between the media roll 32 and the overdrive device 20; it may then have a small amount of travel, and later it will slip with respect to said overdrive device 20; during this process, by effect of the friction and the possibility of slippage between the media and the output driving device, the media undergoes a certain lateral displacement or rotation and becomes aligned at right angles to the axis 33 of the media roll 32.

In other words, the axis 33 of the media roll is the reference for alignment of the media 30 when the media is pulled between the media roll 32 and the overdrive device 20.

The disengagement of the media 30 from the pinch rollers 12, which during normal advance constrain the media in transverse direction, allows the lateral displacement or rotation of the media, and thus the skew reduction.

The flow diagram of FIG. 2*a* illustrates a particular embodiment of the method, especially useful in case of relatively thin media, in which the following steps (100 to 130) are performed after the media has been fed past the overdrive device 20:

- the media is moved in the direction B a small distance of between 10 and 50 mm, usually about 25 mm, by means of the pinch rollers, without becoming disengaged from the overdrive device 20 (step 100); as a result, a small length of loose media is provided upstream of the output driving device, between the media roll and the pinch rollers;
- the pinch rollers 12 are opened and disengaged from the media 30 (step 110);
- the overdrive 20 is operated and attempts to advance the media 30 in the direction A over a distance of between 100 and 300 mm, usually about 150 mm; at the beginning the overdrive may advance the media, but later, once the loose media is consumed, the resistance to advance will increase suddenly, as a result of the weight of the media roll and/or of the passive brake, so the media will start slipping in the overdrive while the overdrive rotates, and this will cause reduction of the skew, as described above (step 120);
- the pinch rollers 12 are closed and again engaged with the media 30 (step 130).

The amount of actual advance of the media will depend on its thickness: for thin media the friction between overdrive and media is relatively small, so the advance will also be small, while in the case of thick media there may be a larger amount of advance before the media starts slipping in the overdrive, because there will be more friction between the overdrive and the media.

By performing this method, at least part of the media skew is removed; on the other hand, the risk of causing wrinkles in the process is small, due to the limited amount of travel the media undergoes in skewed condition.

The step of moving the media in direction B such that a small amount of media remains loose between the media roll and the pinch rollers has the advantage of improving the friction between overdrive and media, due to the sudden pull after the loose media is taken up; however, this step may be omitted, because even if there is no loose media and the overdrive starts pulling the media against the back tension there will still be a pulling force by the overdrive on the media that will tend to correct the skew.

It is also possible to form the bubble of loose media by manually unwinding the media from the media roll, instead of moving the media in the direction B by means of the pinch rollers; in this case, the bubble of loose media may be formed either before or after the pinch rollers are opened.

FIG. 2*b* shows a flow diagram of another embodiment of a method for reducing skew, which involves the following steps (200 to 230) after the media has been fed past the overdrive device, like in the previous embodiment:

the media 30 is advanced in the direction A a distance of between 100 and 300 mm, usually about 150 mm, while engaged both in the pinch rollers 12 and the overdrive 20 (step 200);

the pinch rollers 12 are opened and disengaged from the media 30 (step 210);

the media 30 is moved back in direction B the same distance of between 100 and 300 mm, usually about 150 mm, by being wound back on the media roll 32 while the overdrive 20 is stationary (step 220);

the pinch rollers 12 are closed and again engaged with the media 30 (step 230).

Rewinding of the media on the media roll may be performed by means of a motor or manually by a user, provided it is the media roll that pulls the media so as to align it with respect to the media axis.

In embodiments of the invention the overdrive is provided with a one way bearing system that only allows it to move in the advance direction, such that it remains stationary while the media is moved back in step 220.

The backward movement of the media in direction B can be performed in one single step; however, it may also be carried out in several successive steps, the movement being stopped between two steps, such that the media is pulled several times from a stationary condition. This increases the friction between the media and the overdrive and thus may obtain a certain improvement in skew reduction.

The initial advance of the media in direction A may be omitted if during the loading operation or during skew measurement a sufficient length of media has already advanced past the overdrive to allow the subsequent backward movement without becoming disengaged from the overdrive.

The method of FIG. 2*b* can be performed especially with relatively thick media, where wrinkles are less likely to occur.

However, the method of FIG. 2*b* can also be performed after the method of FIG. 2*a* has been completed, for example if the degree of skew of the media is still above a desired value.

In this case, even if the method of FIG. 2*b* involves a somewhat larger media advance through the engaged pinch rollers, the risk of wrinkles is low even with thin media, because a first skew correction has already been performed and thus the degree of skew will already be relatively small.

Each of the methods of FIG. 2*a* or 2*b*, possible variants thereof, or a combination as explained above, can be performed once skew has been measured and found to exceed a certain value, or they can be included in the loading operation of each new media roll, without previously measuring skew. Similarly, in case both methods are foreseen in succession, the method of FIG. 2*b* can be triggered after the end of the method of FIG. 2*a*, or alternatively a further measure of the skew can be foreseen after the method of FIG. 2*a*, and only in case the newly measured skew exceed a certain value is the method of FIG. 2*b* performed.

It is also possible that the control software triggers one method or another depending on the kind of media loaded in the printer, and/or the initial skew measured, etc.

At the end of the skew-reducing method foreseen in each particular case, media skew may be again measured and compared with a predetermined threshold value, for example 2 mm/m or 3 mm/m; this threshold depends on the kind of media. If skew exceeds the threshold, then the loading operation would fail and the user would be required to load the media again from the start.

However, by virtue of embodiments of the method according to the invention, the success rate in the media loading operation can be raised; or a smaller skew can be required without lowering the success rate.

FIG. 3 shows the results of a test carried out by the applicant on 30 roll media loads using semigloss roll media 42 inch wide; this figure shows the percentage success rate of the loading operation against the degree of skew that is accepted for the loading operation to be successful. The lower line represents the rate of success without applying a skew reducing method after the user loads the media, and the upper line represents the rate of success after applying the method of FIG. 2*a*.

The results clearly show the improvement brought about by the method: as seen in the figure, for example, with a maximum acceptable skew of 2.00 mm/m, about 90% of the loading operations were successful when skew reduction was performed, against only 60% with no skew reduction; and with a maximum admitted skew of 3 mm/m, a success rate of 95% was obtained with skew reduction, against a success rate under 70% without skew correction.

Rewinding of the media on the media roll can be performed by the user manually, simply by rotating the media roll backwards, or by means of a motor arranged to rotate the media roll in reverse, like already present in some models of printers.

Similarly, in some embodiments the pinch rollers or other input driving device can be disengaged manually by the user, or an actuator for this function can be arranged in the printer under the control of the printer software in order to perform the operation without user intervention.

In case some operations need to be performed manually by the user, the method may include appropriate steps in which the control software instructs the user of the operation to be performed, for example through the printer display.

Even though in the foregoing some embodiments of the method for reducing skew have been described associated to the loading operation of a new media roll in a printer, it will be understood that it is also applicable later on, at any time after the loading operation and after any length of media has already been printed, if it is deemed convenient to correct or reduce media skew.

Furthermore, even if methods according to the invention may be particularly suitable in an apparatus handling large format media, and have been described in relation to roll media such as paper used in a printer, its application is not limited to a particular media advance apparatus or media dimension.

The invention claimed is:

1. A method for reducing media skew in a media advance mechanism, comprising the steps of:

feeding media from a media roll, arranged about an axis, by engaging the media with an input driving device and an output driving device of the media advance mechanism, wherein the output driving device engages the media with lower friction than said input driving device;

releasing said input driving device from its engagement with the media such that it does not engage the media while continuing the engagement of the output driving device with the media; and causing the media to move in the media advance mechanism such that the media is pulled taut between the roll and the output driving device and later the media slips with respect to said output driving device, whereby the media is aligned at right angles to the roll axis by effect of the friction between the media and the output driving device.

2. A method as claimed in claim 1, wherein the media is caused to move in the media advance mechanism by being pulled by the output driving device in a media advance direction.

3. A method as claimed in claim 2, said method further comprising a step of providing a length of loose media upstream of the output driving device, prior to the step of moving in the media in a media advance direction.

4. A method as claimed in claim 3, wherein the step of providing a length of loose media is performed before the step of releasing the input device, by operating the input driving device in a direction opposite to the media advance direction.

5. A method as claimed in claim 1, wherein the media is caused to move in the media advance mechanism in a direction opposite a media advance direction, by being rewound on the media roll.

6. A method as claimed in claim 5, wherein the output driving device is maintained stationary while the media is rewound on the roll.

7. A method as claimed in claim 5, wherein the media is caused to move in a direction opposite a media advance direction in several successive steps.

8. A method as claimed in claim 5, said method further comprising the step of advancing the media a predetermined distance in the media advance direction, before the step of releasing the input driving device.

9. A method as claimed in claim 1, wherein said step of causing the media to move in the media advance mechanism comprises causing the media to move in the media advance mechanism by being pulled by the output driving device in a media advance direction, and wherein after this step the method further comprises the steps of:

engaging the input driving device such that it engages the media, moving the media a predetermined distance in the media advance direction, releasing the input driving device such that it does not engage the media; and causing the media to move in the media advance mechanism in a direction opposite a media advance direction, by being rewound on the media roll.

10. A method as claimed in claim 1, wherein said step of causing the media to move in the media advance mechanism comprises causing the media to move in the media advance mechanism by being pulled by the output driving device in a media advance direction, and wherein after this step the method further comprises the steps of:

engaging the input driving device such that it engages the media, measuring the skew of the media, and if the measured skew exceeds a predetermined value, perform the additional steps of:

releasing the input driving device such that it does not engage the media; and causing the media to move in the media advance mechanism in a direction opposite a media advance direction, by being rewound on the media roll.

11. A method as claimed in claim 1, wherein the media roll is arranged on a spindle.

12. A method as claimed in claim 1, wherein the media advance mechanism is a media advance mechanism of a printing apparatus.

13. A method as claimed in claim 12, wherein the input driving device comprises a grit roller and a plurality of pinch wheels cooperating with said grit roller.

14. A method as claimed in claim 12, wherein the output driving device comprises a plurality of rubber rollers and a plurality of star wheels cooperating with said rubber rollers.

15. A method as claimed in claim 12, wherein the output driving device comprises at least one driving roller and a vacuum system urging the media against said roller.

16. A method as claimed in claim 1, wherein in use the force exerted by the output driving device on the media is between 2 N/m and 10 N/m.

17. A method for loading media in a printer, comprising the steps of causing the media to engage an input driving device of the printer and an output driving device of the printer, measuring the skew of the media, and in case the measured skew exceeds a predetermined value, performing a method for reducing media skew as claimed in claim 1.

18. A method for reducing media skew in a media advance mechanism, comprising the steps of:

feeding media from a media roll, arranged about an axis, by engaging the media with an input driving device and an output driving device of the media advance mechanism, wherein the output driving device engages the media with lower friction than said input driving device;

releasing said input driving device from its engagement with the media such that it does not engage the media while continuing the engagement of the output driving device with the media; and operating the output driving device to attempt to advance the media, such that the media is pulled taut between the roll and the output driving device, and later the media slips with respect to the output driving device and is aligned at right angles to the roll axis.

19. A method as claimed in claim 18, further comprising the step of providing a length of loose media upstream of the output driving device, prior to the step of operating the output driving device.

20. A method for reducing media skew in a media advance mechanism, comprising the steps of:

feeding media from a media roll, arranged about an axis, by engaging the media with an input driving device and an output driving device of the media advance mechanism, wherein the output driving device engages the media with lower friction than the input driving device;

advancing the media in the media advance mechanism a predetermined distance, in a media advance direction;

releasing said input driving device from its engagement with the media such that it does not engage the media while continuing the engagement of the output driving device with the media; and rewinding the media on the media roll a predetermined distance, such that the media is pulled taut between the roll and the output driving device, and later the media slips with respect to the output driving device and is aligned at right angles to the roll axis.

* * * * *